US009347198B2

(12) United States Patent
Kleis et al.

(10) Patent No.: US 9,347,198 B2
(45) Date of Patent: May 24, 2016

(54) DEVICE AND METHOD FOR REPAIRING A VERGE

(71) Applicant: H. Lotterman Beheer B.V., Ruinen (NL)

(72) Inventors: Jan Kleis, Ruinerwold (NL); Sander Lotterman, Ruinerwold (NL)

(73) Assignee: H. Lotterman Beheer B.V., Ruinen (NL)

( * ) Notice: Subject to any disclaimer, the term of this patent is extended or adjusted under 35 U.S.C. 154(b) by 3 days.

(21) Appl. No.: 14/358,491

(22) PCT Filed: Nov. 8, 2012

(86) PCT No.: PCT/NL2012/050787

§ 371 (c)(1),
(2) Date: May 15, 2014

(87) PCT Pub. No.: WO2013/077731

PCT Pub. Date: May 30, 2013

(65) Prior Publication Data

US 2015/0003912 A1 Jan. 1, 2015

(30) Foreign Application Priority Data

Nov. 22, 2011 (NL) ..... 2007840

(51) Int. Cl.

| | |
|---|---|
| ***E02F 3/18*** | (2006.01) |
| ***E01C 23/08*** | (2006.01) |
| ***E02F 3/78*** | (2006.01) |
| ***E01H 1/00*** | (2006.01) |
| ***E01C 19/15*** | (2006.01) |
| ***E01C 23/06*** | (2006.01) |
| ***E01C 19/00*** | (2006.01) |
| ***E01C 19/34*** | (2006.01) |
| ***E02F 5/22*** | (2006.01) |
| ***E01C 23/088*** | (2006.01) |

(52) U.S. Cl.

CPC ..... *E02F 3/181* (2013.01); *E01C 19/002* (2013.01); *E01C 19/15* (2013.01); *E01C 19/34* (2013.01); *E01C 23/06* (2013.01); *E01C 23/088* (2013.01); *E01C 23/0885* (2013.01); *E01H 1/003* (2013.01); *E02F 3/18* (2013.01); *E02F 3/78* (2013.01); *E02F 5/223* (2013.01)

(58) Field of Classification Search

CPC ..... E01C 19/268; E01C 19/27; E01C 19/26; E01C 19/266; E01C 19/22; E01C 19/15; E01C 23/0885; E01C 23/06; E01C 23/088; E02F 5/223; E02F 3/181; E02F 3/78; E02F 3/18; E01H 1/003

USPC ..... 404/104, 127

See application file for complete search history.

(56) References Cited

U.S. PATENT DOCUMENTS 3,146,686 A * 9/1964 Grace et al. ..... 404/127
5,304,013 A * 4/1994 Parsons ..... 404/127

(Continued)

FOREIGN PATENT DOCUMENTS

DE 3101216 A1 9/1982
DE 29618367 U1 3/1997

(Continued)

*Primary Examiner* — Abigail A Risic
(74) *Attorney, Agent, or Firm* — The Webb Law Firm

(57) ABSTRACT

The invention relates to a device for repairing a verge. The device includes: a base frame for attaching the device to a mobile tool, such as a crane; a subframe arranged on the base frame; and a flexible sleeve which is arranged on the subframe and revolves so as to be movable with respect to the base frame. In addition, the invention relates to a method for repairing a verge.

18 Claims, 3 Drawing Sheets

(56) References Cited

U.S. PATENT DOCUMENTS 6,435,766 B1 * 8/2002 Titford ..... 404/75
6,612,774 B1 * 9/2003 Dulin ..... 404/104

FOREIGN PATENT DOCUMENTS

DE 19851828 A1 5/2000
SU 567800 A1 8/1977

* cited by examiner

DEVICE AND METHOD FOR REPAIRING A VERGE

CROSS-REFERENCE TO RELATED APPLICATIONS

This application is the United States national phase of International Application No. PCT/NL2012/050787 filed Nov. 8, 2012, and claims priority to Netherlands Patent Application No. 2007840 filed Nov. 22, 2011, the disclosures of which are hereby incorporated in their entirety by reference.

BACKGROUND OF THE INVENTION

1. Field of the Invention

The invention relates to a device for repairing a verge.

2. Description of Related Art

In particular in areas outside towns and cities, the problem occurs of damage to verges of roads, such as country roads. The relatively narrow roads force the traffic to use the verges when trying to avoid or overtake other traffic. In bends, damage is also caused by the fact that traffic cuts off corners or takes the bends too wide. This may result in deep trenches and trails and often produces dangerously high and steep edges on the side of the metalling of the road. Once these trenches and trails have formed, the process of deepening is accelerated by the fact that precipitation collects in the lower parts. This water leads to soft mud in the trenches which is easily moved along when a vehicle drives through the trenches again.

In addition, the road surface itself may become damaged as the road surface is no longer supported at the location of the trenches. As a result thereof, the road surface can easily cave in or break away.

It is therefore important to prevent damage to the verge or to repair any damage in time. Damage may be prevented by covering the verge with strips of rubble or by laying grass concrete blocks. The drawback of this solution is the high cost associated with arranging the rubble or the grass concrete blocks on the verge.

In addition, it is often not desirable to give traffic users the impression that the road has been widened by providing metalling next to the standard road, since this results in an increase in travelling speed and consequently leads to dangerous traffic situations.

On the other hand, it is possible to repair the verge regularly. This is usually carried out by means of a crane provided with a scoop which removes portions of the verge and fills up the trenches again therewith. However, this is very labour-intensive and time-consuming. In addition, there is a risk that the scoop may damage the road surface.

It is now an object of the invention to reduce or to prevent the abovementioned drawbacks.

SUMMARY OF THE INVENTION

This object is achieved by a device according to the preamble, which device comprises:

- a base frame for attaching the device to a mobile tool, such as a crane;
- a subframe arranged on the base frame; and
- a flexible sleeve which is arranged on the subframe and revolves so as to be movable with respect to the base frame.

As a result of the revolving movement of the sleeve, parts of the verge can be scraped off and moved to the trench in the verge. The revolving movement is a continuous movement, unlike, for example, the to-and-fro movement of a scoop of a crane, as is the case in the prior art. When the flexible sleeve is pushed against the edge of the road surface and the verge, the sleeve may start to revolve of its own accord, due to the difference in friction, thus distributing the parts of the verge evenly.

In addition, the flexible sleeve ensures that sufficient pressure can be exerted to be able to scrape off parts of the verge, while minimizing damage to the road surface or other hard parts on the verge. Moreover, the flexible sleeve will adapt to the uneven structures present in the verge, thus producing optimum contact between the device and the verge.

The advantage of using a flexible sleeve is that the pressure can readily be adjusted. A crane can push the device onto the ground and, due to the fact that the flexible sleeve is compressed, the pressure is increased more slowly than would be the case if a non-flexible part were to be pushed onto the ground, such as a steel scoop of a crane.

In a preferred embodiment of the device according to the invention, the subframe is arranged on the base frame in a rotating manner and the flexible sleeve is arranged around the subframe. By driving the subframe in a rotating manner, a strong and reliable device is thus produced.

In another preferred embodiment of the device according to the invention, the flexible sleeve is a vehicle tire, such as a tire of a tractor.

Vehicle tires are readily available, so that they can quickly be replaced when the flexible sleeve becomes damaged. Moreover, vehicle tires are designed to be durable and resistant to wear, which is a considerable advantage with this invention.

The flexible sleeve may also be shaped by a large number of rigid elements which are resiliently mounted and which together form a flexible sleeve. Another embodiment of the invention comprises a conveyor belt which is arranged between at least two turning wheels on the subframe, in which case the flexible sleeve is formed by at least one edge of the conveyor belt.

Using a conveyor belt, it is possible to produce an elongate, continuous sleeve, allowing a wider area of a verge to be levelled. Another preferred embodiment of the device according to the invention comprises tilting means for tilting the subframe with respect to the base frame. When the device is attached to a moving vehicle, the position of the vehicle with respect to the surface of the verge may prevent the device from being used efficiently. Due to the tilting means, it is possible to align the position of the device correctly with respect to the road surface and the surface of the verge.

Yet another embodiment of the device according to the invention comprises drive means for continuously driving the sleeve. Preferably, the drive means comprise a hydraulic motor.

Driving the subframe results in a constant rotation of the subframe, as a consequence of which the evening out of the verge takes place in a more reliable manner. In this case, the use of a hydraulic motor has the advantage that a large force can be transmitted. In addition, the mobile tools to which the device can be fitted are often provided with a hydraulic system.

The invention furthermore relates to a method for repairing the verge of a road using a device according to the invention, which method comprises the following steps:

- positioning the device according to the invention with respect to the road in such a manner that the plane of movement of the sleeve is substantially parallel to the road surface;

pushing a part of the flexible sleeve onto the edge of the road, adjacent to the verge to be repaired, with the remaining part of the flexible sleeve extending across the verge;

moving the device along and parallel to the edge of the road, with the sleeve revolving and displacing parts of the verge in such a way that the verge is evened out.

Pushing a part of the flexible sleeve onto the edge of the road, with the remaining part of the flexible sleeve extending across the verge, ensures that the levelled verge merges with the road smoothly.

In addition, by tilting the device, the angle of the surface of the verge with respect to the road surface can be adjusted.

A preferred embodiment of the method according to the invention comprises the step of tamping down the parts which have been evenly distributed across the verge. When the parts of the verge have been scraped off by the device and evenly distributed across the verge, it is preferable to tamp down these parts again.

Although the parts will grow together of their own accord as a result of, for example, the grass or other plants in the scraped-off parts, it is preferable to tamp down the parts. This ensures that the parts, as long as the parts have not grown together, do not become dislodged again easily, for example when a vehicle drives over the verge.

In a highly preferred embodiment of the method according to the invention, the device according to the invention is fitted to the arm of a mobile crane and the crane tamps down the parts which have been evenly distributed across the verge with at least one wheel.

BRIEF DESCRIPTION OF THE DRAWINGS

These and other features of the invention are explained in more detail with reference to the attached drawings, in which.

DESCRIPTION OF THE INVENTION

Figure 1:
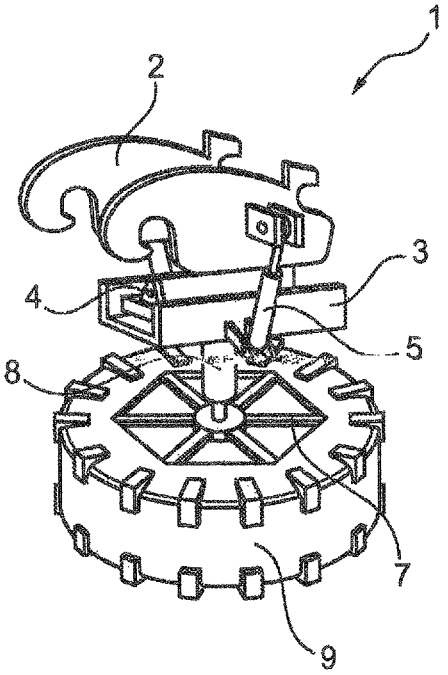
FIG. 1 shows a perspective view of a first embodiment of the device according to the invention.

FIG. 1 shows a device 1 for repairing a verge. The device 1 has a two-part base frame 2, 3 which can be coupled to the arm of a crane, for example.

The two parts 2, 3 of the base frame are hingedly connected to each other via hinge pin 4. By means of hydraulic cylinders 5, 6, the position of the bottom part 3 of the base frame with respect to the top part 2 can be adjusted.

A subframe 7 is fitted to the bottom part 3 and can rotate with respect to the bottom part 3. In this case, a hydraulic motor is provided in the shaft 8 to actively drive the subframe 7.

The subframe 7 is provided with a flexible sleeve 9 which, in this embodiment, is a tractor tire. In this way, an inexpensive, yet durable and wear-resistant flexible sleeve 9 is provided.

Figure 2:
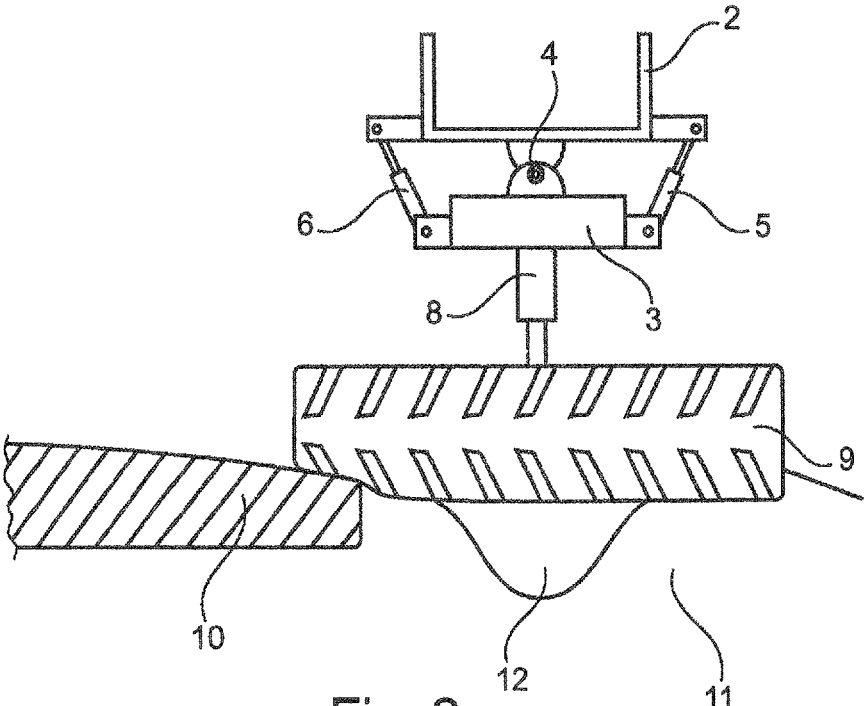
FIG. 2 shows a front view of the device from FIG. 1 during use.

FIG. 2 shows a front view of the device 1 from FIG. 1 during use. A part of the flexible sleeve 9 of the device is pushed onto the edge 10 of the road surface. In this case, the flexible sleeve 9 will be slightly compressed, resulting in good contact. By now moving the device along the edge 10 of the road surface, the subframe 7 will revolve of its own accord. However, by using the hydraulic motor 8, a reliable and continuous rotation of the subframe 7 will be achieved.

The remaining part of the flexible sleeve 9 is situated on the verge 11, in which a trench 12 is formed. However, the flexible sleeve 9 will scrape off parts of the verge 11 and move them to the trench 12 so that the verge 11 is restored.

Figure 3:
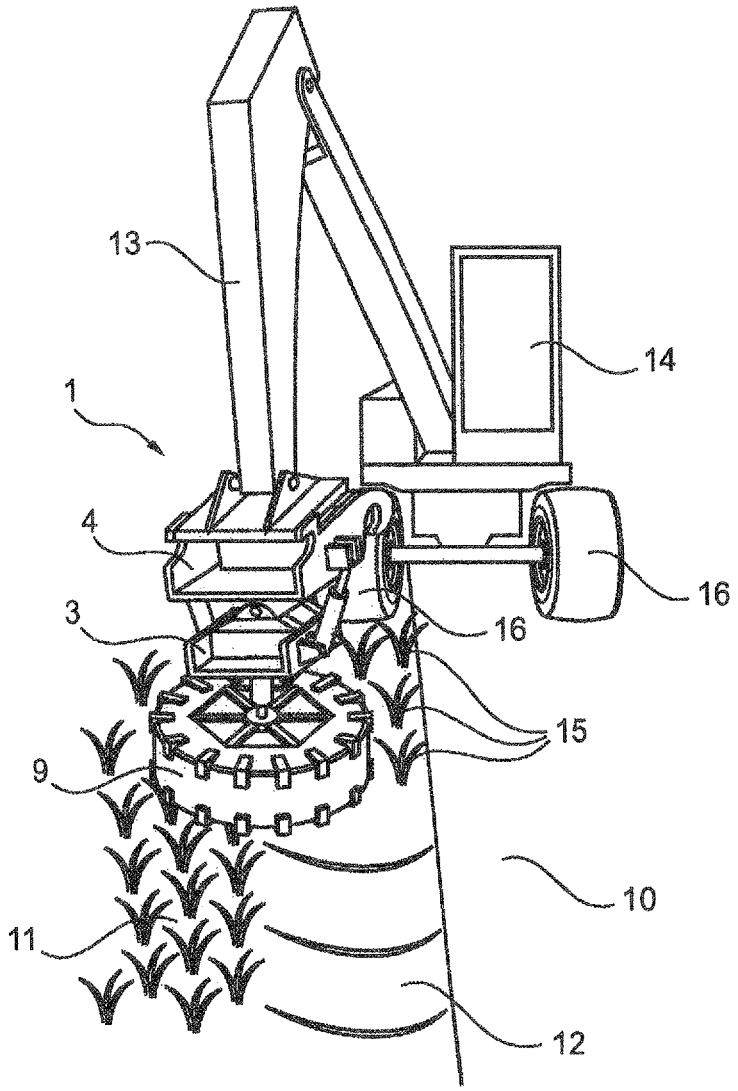
FIG. 3 shows a perspective view of the device from FIG. 1 fitted to a crane.

FIG. 3 shows the device 1 fitted onto the arm 13 of a mobile crane 14. By means of the flexible sleeve 9 of the device 1, parts 15 of the verge 11 are loosened and pushed into the trench 12.

While the device 1 is being moved along the edge of the road 10, the crane 14 will also move across the road, in which case the wheels 16 of the crane 14 tamps down the parts 15 of the verge 11 which have been pushed into the trench 12.

Figure 4:
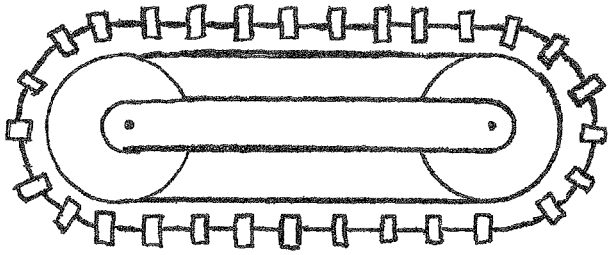
FIG. 4 is a schematic of a conveyor belt which is arranged between two turning wheels on a subframe.

FIG. 4 shows a schematic of a conveyor belt 20 which is arranged between two turning wheels 21, 22 on a subframe 23.

The invention claimed is:

1. A device for repairing a verge of a road, which device comprises:

a base frame for attaching the device to a mobile tool, such as a crane;

a subframe arranged on the base frame;

a flexible sleeve which is arranged on the subframe and revolves so as to be movable with respect to the base frame, wherein the subframe is arranged on the base frame in a rotating manner; and a drive for actively driving the subframe and the sleeve arranged thereto to displace parts of the verge in such a way that the verge is evened out;

wherein the device is configured to be positioned with respect to a surface of the road in such a manner that the plane of movement of the sleeve is substantially parallel to the road surface.

2. The device according to claim 1, in which the flexible sleeve is a vehicle tire, such as a tractor tire.

3. The device according to claim 1, further comprising a conveyor belt which is arranged between at least two turning wheels on the subframe, in which the flexible sleeve is formed by at least one edge of the conveyor belt.

4. The device according to claim 1, wherein the drive continuously drives the sleeve.

5. The device according to claim 1, in which the drive comprises a hydraulic motor.

6. The device according to claim 1, further comprising a tilting mechanism for tilting the subframe with respect to the base frame.

7. The device according to claim 1, wherein the drive is for continuously driving the sleeve.

8. The device according to claim 2, wherein the drive is for continuously driving the sleeve.

9. The device according to claim 3, wherein the drive is for continuously driving the sleeve.

10. The device according to claim 2, further comprising a tilting mechanism for tilting the subframe with respect to the base frame.

11. The device according to claim 3, further comprising a tilting mechanism for tilting the subframe with respect to the base frame.

12. The device according to claim 5, further comprising a tilting mechanism for tilting the subframe with respect to the base frame.

13. The device according to claim 7, further comprising a tilting mechanism for tilting the subframe with respect to the base frame.

14. The device according to claim 8, further comprising a tilting mechanism for tilting the subframe with respect to the base frame.

15. A method for repairing a verge of a road using a device comprising:

a base frame for attaching the device to a mobile tool, such as a crane;

a subframe arranged on the base frame;

a flexible sleeve which is arranged on the subframe and revolves so as to be movable with respect to the base frame; and a drive for driving the sleeve;

wherein the subframe is arranged on the base frame in a rotating manner and wherein the flexible sleeve is arranged around the subframe;

said method comprising the following steps:

positioning the device with respect to the road in such a manner that the plane of movement of the sleeve is substantially parallel to the road surface;

pushing a part of the flexible sleeve onto the edge of the road, adjacent to the verge to be repaired, with the remaining part of the flexible sleeve extending across the verge; and actively driving the subframe and the sleeve arranged thereon to displace parts of the verge in such a way that the verge is evened out;

moving the device along and parallel to the edge of the road, with the sleeve revolving and distributing parts of the verge evenly across the verge.

16. The method according to claim 15, further comprising the step of tamping down the parts which have been evenly distributed across the verge.

17. The method according to claim 16, in which the device is fitted to the arm of a mobile crane and in which the crane tamps down the parts which have been evenly distributed across the verge with at least one wheel.

18. A device for repairing a verge, which device comprises:

a base frame for attaching the device to a mobile tool, such as a crane;

a subframe arranged on the base frame;

a flexible sleeve which is arranged on the subframe and revolves so as to be movable with respect to the base frame, wherein the subframe is arranged on the base frame in a rotating manner and wherein the flexible sleeve is arranged around the subframe; and a conveyor belt which is arranged between at least two turning wheels on the subframe, in which the flexible sleeve is formed by at least one edge of the conveyor belt.

* * * * *